United States Patent [19]

Ishizuka

[11] 4,401,543

[45] Aug. 30, 1983

[54] ELECTROLYTIC CELL FOR MAGNESIUM CHLORIDE

[76] Inventor: Hiroshi Ishizuka, 19-2, Ebara 6-chome, Sinagawa-ku, Tokyo, Japan

[21] Appl. No.: 325,036

[22] Filed: Nov. 25, 1981

[30] Foreign Application Priority Data

Dec. 11, 1980 [JP] Japan ..... 55-173839
Jul. 31, 1981 [JP] Japan ..... 56-121172

[51] Int. Cl.[3] ..... C25C 3/04; C25C 7/02

[52] U.S. Cl. ..... 204/244; 204/245; 204/268; 204/288; 204/292; 204/290 R; 204/294; 204/70

[58] Field of Search ..... 204/70, 243 R–247, 204/290 R, 294, 292, 268, 288

[56] References Cited

U.S. PATENT DOCUMENTS

| | | | |
|---|---|---|---|
| 3,396,094 | 8/1968 | Sivilotti et al. | 204/70 |
| 3,930,967 | 1/1976 | Alder | 204/268 X |
| 4,055,474 | 10/1977 | Sivilotti | 204/70 |
| 4,334,975 | 6/1982 | Ishizuka | 204/290 R X |

FOREIGN PATENT DOCUMENTS

| | | | |
|---|---|---|---|
| 186981 | 11/1966 | U.S.S.R. | 204/268 |

*Primary Examiner*—Donald R. Valentine

*Attorney, Agent, or Firm*—Larson and Taylor

[57] ABSTRACT

An improved electrolytic cell for magnesium chloride which essentially comprises:

at least one pairs of anode and cathode arranged with a respective principal face thereof in a substantial verticality, at least one bipolar intermediate electrode placed in a row between the anode and cathode, an electrolytic chamber to contain such electrodes, and a metal collecting chamber which is attached to the electrolytic chamber but separated therefrom by a partition, characterized in that said intermediate electrodes essentially consists of a substantially flat graphite portion to provide an anodic face and an iron portion to provide a cathodic face, both materials being spaced from each other and jointed together with rods of iron, which are tightly secured to the graphite, to ensure an intimate electrical connection therebetween, and that a cavity thus formed between the two materials is arranged to fitly communicate at one end with a through hole in the partition to allow passage of electrolyte bath carrying magnesium metal product from the electrolytic chamber to the metal collecting chamber.

20 Claims, 13 Drawing Figures

ELECTROLYTIC CELL FOR MAGNESIUM CHLORIDE

The present invention relates to an improved electrolytic cell for magnesium (di-)chloride to obtain magnesium metal and chlorine gas, particularly, to such as essentially comprising at least one pairs of anode and cathode along with one or more intervening bipolar electrodes.

Electrolytic cells of various designs have been proposed for industrial production of magnesium metal by electrolytic decomposition of magnesium chloride. They basically comprise one or more pairs of anode and cathode held in a common chamber without any or with some bipolar intermediate electrodes placed in series between such electrodes.

In cell designing special technology is required to recover a product of magnesium metal which forms in the reaction and moves upwards in an ambient electrolyte bath, while effectively preventing its contact with the other product of also ascending chlorine gas to convert back to the chloride. On the other hand it is desirable that a single cell should as many sets of such electrodes as allowable for technically available improved production capacity. However, such technical needs are rather incompatible, and they have never been met, as far as the Applicant is aware, to any satisfactory degree.

Some cell arrangements are known which comprise several pairs of anode and cathode for a raised production capacity per cell. Among them, for example, U.S. Pat. No. 3,676,323 describes a cell which has a plurality of electrode sets of anode and cathode, in which two principal sides of a flat iron plate serve as cathodic face to adjacent anodes. In this design a low power efficiency is expectable because of lack of any means shown for protecting magnesium metal against its contact with chlorine gas only to decrease the productivity. Particularly with a type in which an anode is positioned at a bottom of the electrolytic cell, unfavorable wasted power consumption should be inevitable by some heat generation at a connection of anode with the wiring mainly due to practically unattainable sufficient contact between the two parts. In addition anode replacement as worn out appears to call for rather complicated handling.

On the other hand, U.S. Pat. No. 3,907,651 likewise shows an electrolytic arrangement basically of several pairs of anode and cathode, such that two principal sides of the cathodic material are arranged to oppose the adjacent anode. The cathodic material is formed hollow with an internal cavity to serve as passage for electrolyte bath. In operation with this arrangement, bath liquid, carrying magnesium metal, which forms on an outer face of the cathode and ascends in the bath along such face, turns down into the cavity separating from chlorine gas which keeps ascending. The metal product leaves the passage through an opening at one side and, for stripping magnesium metal, enters a metal collecting chamber which is partitioned from the electrolytic chamber. Such electrolyte thus discharged flows back to the electrolytic chamber through an opening placed in a bottom of the partition. Thus with a cell of this design which has a cavity to allow bath flow within the cathode, it appears technically difficult disadvantageously to arrange a substantially increased number of electrode pairs for an improved capacity, due to the cathodes being so thick and placed between adjacent anodes. It appears, in addition, that this particular cell arrangement herein illustrated has a practical difficulty in ensuring air-tight sealing of the top cover due to a plurality of anode electrodes extending through the cover.

The number of electrodes which run through the cell top can be reduced in such arrangements as disclosed, for example, in U.S. Pat. No. 2,468,022 or USSR Inventor's Certificate No. 609,778. Here, a plurality of externally unwired electrodes are placed in series between an anode and cathode so as to provide a cathodic- and an anodic faces on the sides closer to the anode and the cathode, respectively (bipolar property). In this design such disadvantage is expected as an electrolytic consumption of cathodic material (iron) of such intermediate electrode at an interface with the anodic material (graphite) jointed thereto, due to differentiated electrical potentials between the graphite and iron inevitable to the insufficient adhesion described herein.

In still another arrangement disclosed in U.S. Pat. No. 4,055,474, several anodes respectively have two effective faces inclined against the verticality, while the cathodes adjacent to each face are placed with the opposed faces substantially in parallel with such anode faces. This arrangement, indeed, may provide rather an improved power efficiency as a result of somewhat decreased distance successfully achieved between the anode and cathode, however, a major problem still remains unsolved: a substantial improvement in production capacity per cell, hard to achieve because of technically difficult reduction of distance between adjacent anodes so as to allow the cell to contain an increased number of electrode sets, and because air-tight sealing is hard to obtain as in the case of U.S. Pat. No. 3,907,651, mentioned above, due to a plurality of anode electrodes extending through the top cover to outside the cell.

Therefore, one of the principal objectives of the present invention is to provide an improved electrolytic cell, substantially eliminated of the drawbacks described above.

According to the invention there is provided an electrolytic cell of a successfully decreased distance between the electrodes, secured of a substantially identical electrical potential of the cathodic portion to that of the anodic portion of bipolar intermediate electrodes with a cavity between the two portions to allow bath flow therethrough, whereby a substantially improved production capacity is achievable. More specifically, there is provided according to the invention an improved electrolytic cell for magnesium chloride which essentially comprises: at least one pairs of anode and cathode arranged with a respective principal face thereof in a substantial verticality, at least one bipolar intermediate electrode placed in a row between the anode and cathode, an electrolytic chamber to contain such electrodes, and a metal collecting chamber which is attached to the electrolytic chamber but separated therefrom by a partition, characterized in that said intermediate electrodes essentially consists of a substantially flat graphite portion to provide an anodic face and an iron portion to provide a cathodic face, both materials being spaced from each other and jointed together with rods of iron, which are tightly secured to the graphite, to ensure an intimate electrical connection therebetween, and that a cavity thus formed between the two materials is arranged to fitly communicate at one end with a through hole in the partition to allow passage of electrolyte bath carrying magnesium metal product from the electrolytic- to the metal collecting chambers.

Other objectives and various features of the present invention will be better understood from the following description taken in connection with the accompanying drawing which is given by way of example only.

FIG. 1 schematically shows an elevational sectional view of an electrolytic cell of the invention, as seen from one side;

Figure 1:
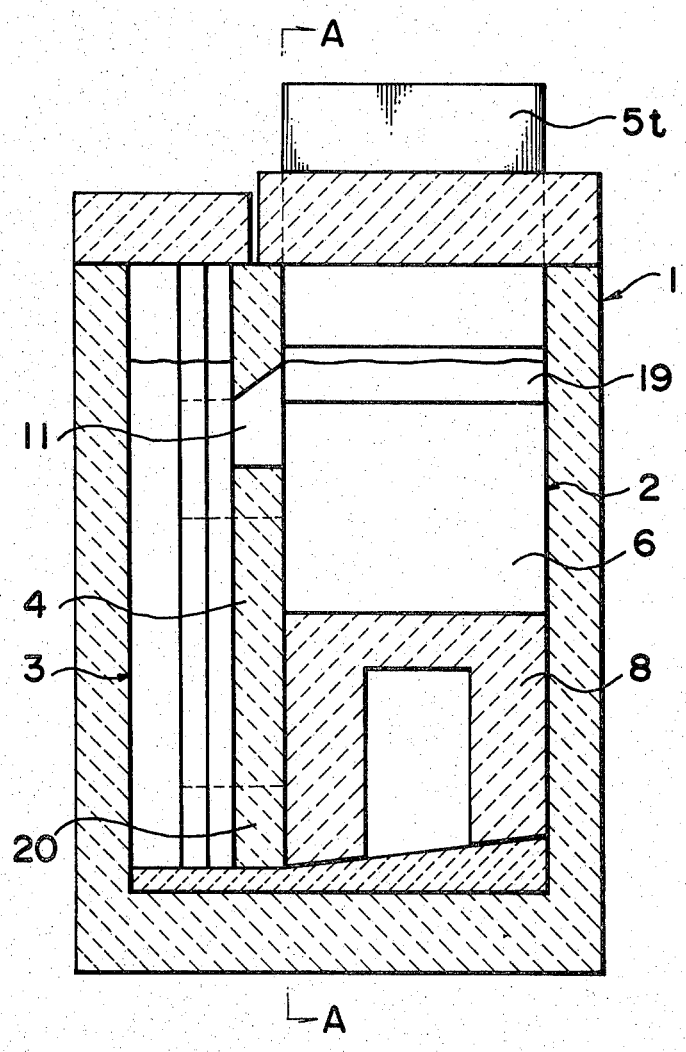

FIGS. 4 to 7 illustrate a few examples of cathodic face arrangement in side view (FIGS. 4 and 6) and front view (FIGS. 5 and 7), a piece or pieces of iron secured to the top of rods, such as bolts and tapered pins, which are deeply planted in a graphite from which the iron is spaced with the rods; and FIGS. 8 to 11 and FIGS. 12 and 13 show some variations of intermediate electrode arrangement in relation to the side and horizontal views, respectively.

In the Figures an electrolytic cell generally designated at 1 essentially consists of an electrolytic chamber 2 and a metal collecting chamber 3, which are separated from each other with a partition 4. In the electrolytic chamber there are placed at one end an anode 5 substantially made of graphite and a cathode 6 of iron at the other, substantially perpendicular to the partition 4. Such electrodes have an end 5*t* and 6*t* thereof outside the cell 1 for electrical connection. The anode 5 and cathode 6 may be so arranged that one polarity is placed at a middle of the chamber, while the other is positioned at either end. Several bipolar intermediate electrodes 7 are placed in a row between the anode 5 and cathode 6. The electrodes of each polarity 5, 6 and 7 are mounted on a platform 8 of electrical insulative material. The platform 8 is provided with a number of slits 9 to allow movement of electrolyte bath and sludge material formed during an electrolytic run, while the chamber 2 has a floor with a downslope towards one side for easier collection of such sludge deposit. The intermediate electrode 7 essentially consists of spaced and jointed portions of graphite and iron, with a cavity 10 which leads to the metal collecting chamber 4 through a hole 11 placed in the partition 4 and so formed as to fit and well communicate with the cavity 10. Although not essential to the invention, the partition favorably has a wall thickness greatest in adjacence to the anode 5 and varying stepwise from a minimum adjacent to the cathode 6, for a better prevention of stray electrical current possible through magnesium metal afloat the bath surface. While a variety of intermediate electrode arrangements are available as shown later, such electrode, generally, is a composite construction of a rather thick flat slab of graphite 12 and a flat facial piece of iron 13 formed singly or integrally of several slats, the graphite and iron being jointed to each other by means of a number of spacer-connector rods 14, which usually are normal threaded bolts 15 or tapered pins 16 of, preferably, iron and are secured to the both materials with a given spacing therebetween, by welding at the top to the iron and planting by the foot in the graphite to a substantial depth, so as to ensure a substantially identical electrical potential for the both portions of the intermediate electrode.

As schematically shown in FIGS. 4 to 7 in side view and partially cutaway front view, respectively, the intermediate electrode 7 may take such configurations that: the iron portion 13 is formed in a single sheet, or a plurality of metal slats, vertical 17 (FIGS. 4 and 5) or horizontal 18 (FIGS. 6 and 7) in a vertical or transversal row, respectively, or a latticework (not shown) of such plate with- or without small gaps between them. Whether consisting of a single sheet, several slats or a latticework, the iron portion 13 is supported substantially in parallel with the opposed flat face of the graphite 12 (FIG. 8), or a little inclined as a whole against the graphite 12 surface of an upward convergence generally (FIG. 9) or partially at an upper portion (FIG. 10), for provision of an upper divergence, as set in the cell, from an opposed face of the adjacent electrode, or with each of the horizontal slats commonly spaced from- and commonly inclined against the graphite so as to exhibit a somewhat saw-toothlike profiled outer face (FIG. 11), or in their combined way. In the saw tooth arrangement it is advantageous that each slat be provided with a slanted lower hem on the inner side. Such hem arrangement is preferred because of effectively prevented magnesium leak outside the cavity and possible contact with chlorine gas to turn back to the chloride. Further with respect to the horizontal arrangement, the cathodic portion of the intermediate electrode 7 preferably is convergent towards one end adjacent to the partition 4 continuously (FIG. 12) or stepwise (FIG. 13) so as to provide, as set in the cell, a spacing from the adjacent electrode narrowing towards the end opposite to the partition 4. This arrangement is especially effective to cause a steady stream of electrolyte bath carrying magnesium product through the cavity within the intermediate electrode, by thus promoting an electrolytic reaction in such a way as to move and force the bath towards the metal collecting chamber through such cavity.

All the electrodes are held in the electrolytic chamber 2 in a substantial verticality, or inclined relative to the verticality at a small degree of, for example $\theta = \tan^{-1} 0.1$, such angle advantageously increasing with anode number per cell so as to obtain a raised production capacity of the cell. The electrodes are placed with each opposed faces substantially in parallel with each other, or with the iron face of electrodes slightly divergent from the opposed graphite face, or in other words, convergent towards the graphitic portion of their own electrodes. Each of such electrodes is positioned with a top thereof well below an electrolyte surface level.

As already mentioned the partition 4 is provided with a row of through holes 11 communicating with the cavities 10 within the intermediate electrodes 7 to let electrolyte bath carrying magnesium metal into the collecting chamber 3. Such holes 11 are usually formed rectangular or parallelogrammic in cross section similarly to the cavity 10 and as broad for a sufficient fitting. The holes have a top (ceiling) at a same level as the cavity throughout the length or somewhat above, but below anyway the bath surface level at the entrance end adjacent to the electrode with a downslope towards the collecting chamber 3 down to the electrode top level. The latter hole formation is especially effective to minimize chlorine gas accompanyment in the bath stream into the chamber 3. While the holes 11 may have a bottom on a level with that of the cavity 10, or a platform top level, it is advantageous that the bottom be somewhat raised from the platform top to provide holes of decreased cross section for causing an accelerated stream of bath which carries magnesium product and flows into the collecting chamber, thus ensuring recovery of magnesium at an improved efficiency and minimizing contact of the metal with chlorine gas to convert back to chloride.

In a preferred example each intermediate electrode 7 is provided atop with an elongated bar 19 of an insulative refractory material which is high enough to reach over the bath surface and lies along the width to prevent any short circuit formation through the magnesium metal afloat the bath surface.

In an electrolytic run magnesium metal and chlorine gas form on the cathodic and anodic faces, respectively, and move upwards in the bath along each electrode face, until the bath as carrying such magnesium flows down into the cavities behind the face away safely from the chlorine which keeps ascending. The magnesium carrying bath flows past the cavity 10, enters the metal collecting chamber 3 through the holes 11, flows down while stripping off of magnesium and a little cooled by a suitable means, such as cold blast on the wall outside of the chamber or a cold air circulation through a tubing immersed in the bath, as disclosed in Japanese Patent Appln. No. 139145/1980 and comes back into the electrolytic chamber 2 through holes 20 at a bottom of the partition 4. Magnesium thus accumulated in the chamber 3 is recovered with a suitable means, while the other product chlorine gas is continuously removed from the cell 1 through an outlet port 21 on a chamber wall at a level well above the bath level.

Conventional technologies are available for feeding bath materials by which the latter is introduced to fill the cell as a premixed solid or liquid of a determined composition.

A metal collecting chamber can be designed for a single electrolytic chamber, but is advantageously shared among such chambers for providing a cell of a compact construction.

EXAMPLE 1

Figure 2:
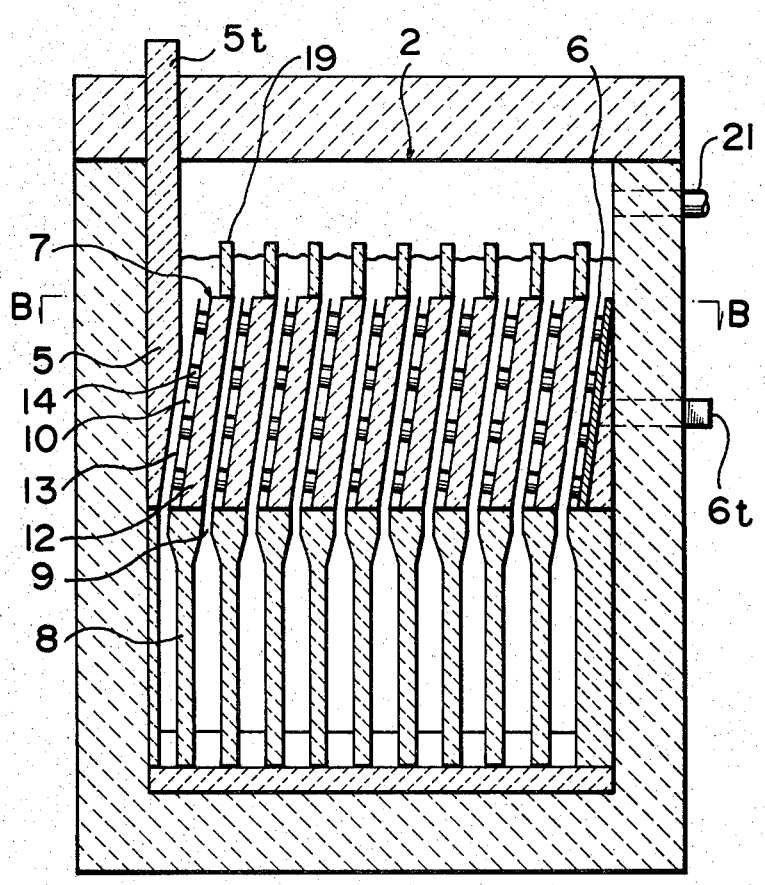
FIG. 2 is a front sectional view of the cell as taken at A—A in FIG. 1.
Figure 3:
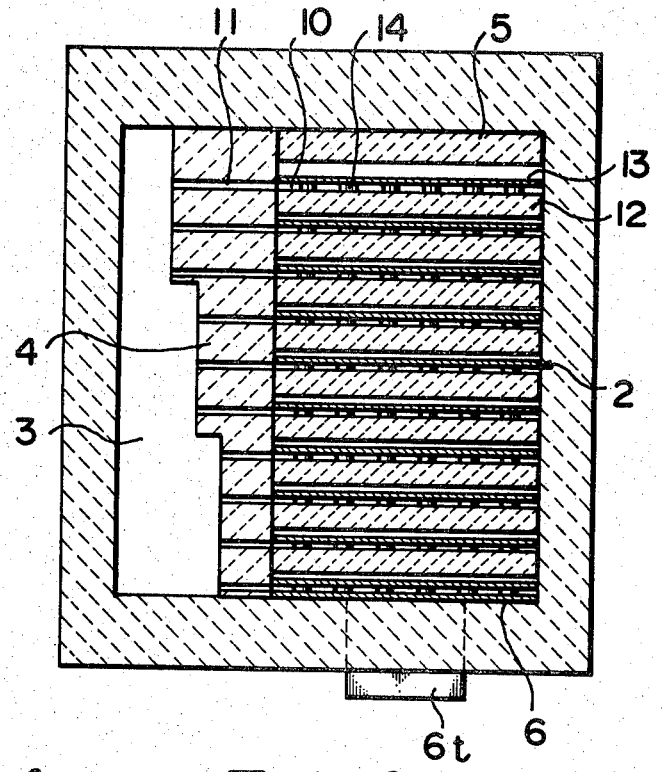
FIG. 3 is a sectional plan as taken at B—B in FIG. 2.
Figure 4:
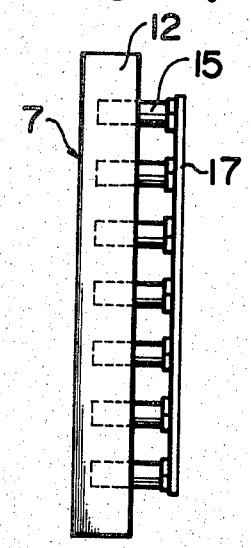
Figure 5:
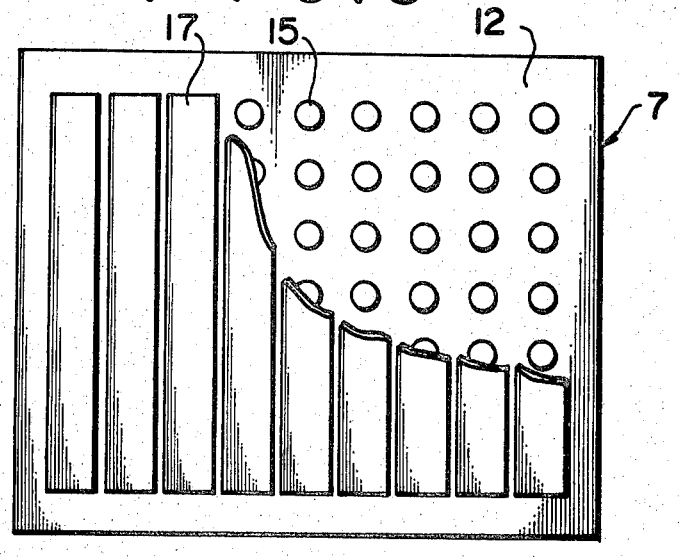
Figure 6:
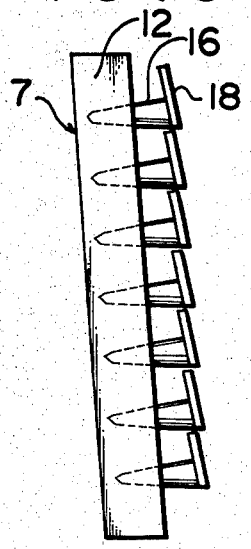
Figure 7:
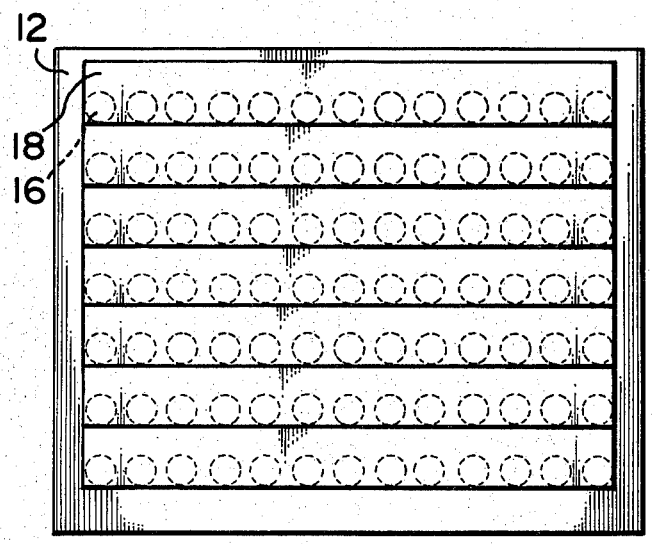
Figure 8:
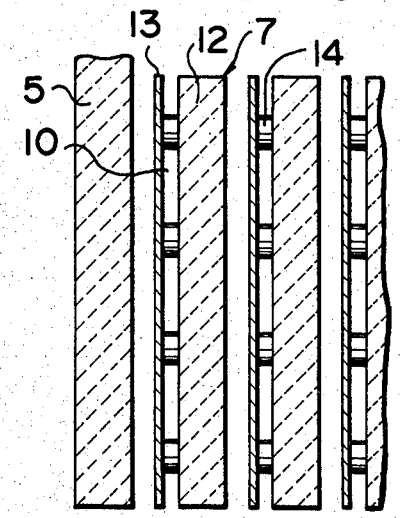
Figure 9:
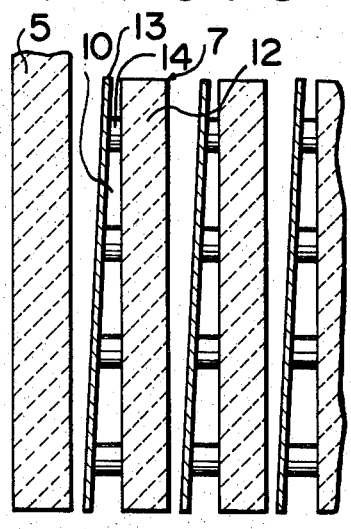
Figure 10:
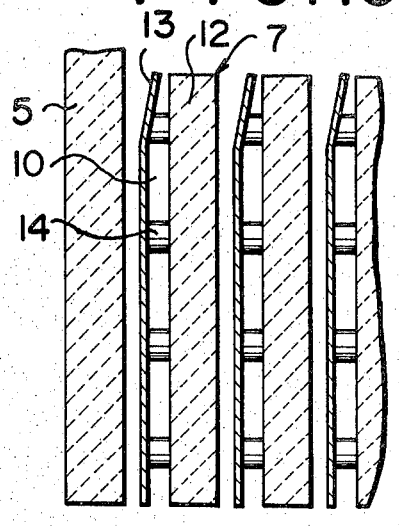
Figure 11:
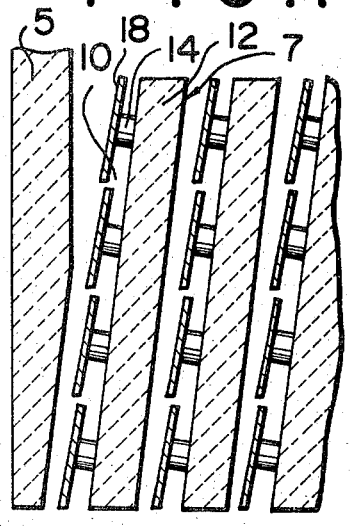
Figure 12:
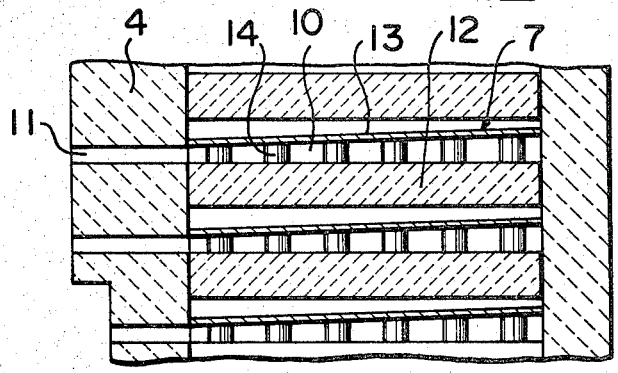
Figure 13:
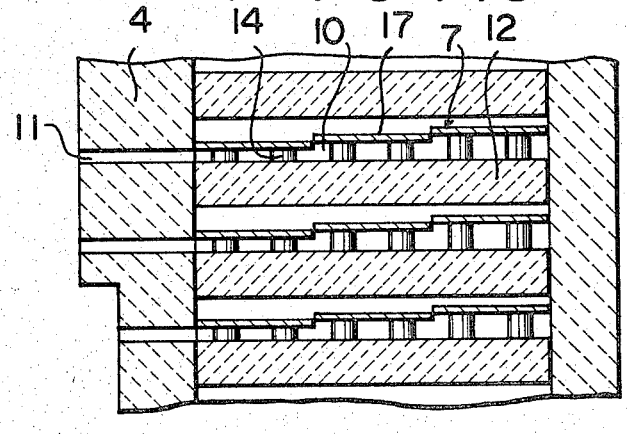

An electrolytic cell was used which essentially had a design shown in FIGS. 1 to 3 and comprised an electrolytic chamber measuring 1 m by 2.28 m by 2.2 m (height) and a metal collecting chamber of 0.2 m by 2.21 m by 2.2 m (height) (measurements made on the inside dimensions), separated with a partition of a stepwise increasing thickness of from 15 cm, adjacent to one end (site for cathode) to 45 cm, adjacent to the other end (site for anode) with a thickness of 30 cm therebetween. In the electrolytic chamber at the respective sites there were placed a graphite slab, as anode, of a 2 m by 1 m cross section and 12.5 cm thick (maximum) with a tapered bottom at 5° (over a 50 cm length), and as cathode, an iron plate 80 cm by 1 m wide, 12.5 cm thick and slanted at a same degree as that of the anode. Nine intermediate electrodes were placed substantially in parallel with such electrodes. Each intermediate electrode consisted of a graphite slab 80 cm by 1 m wide and 12.5 cm thick, jointed to an iron plate 80 cm by 1 m wide 1.5 cm thick by means of 24 iron bolts in 6 cm diameter. The bolts were welded to the iron plate at the head and planted at the bottom into the graphite to a depth of 7.5 cm, thus providing a 4.5 cm broad cavity between the opposed flat faces of the two portions. The intermediate electrodes were seated in a row on divided platforms of alumina brick spaced from each other. Placed on the top of each intermediate electrode was an elongated bar of alumina of 10 cm by 20 cm by 1 m dimensions so as to reach about 5 cm over the bath level. A partition was provided with a series of parallelogrammic through holes which were placed to fit and well communicate with each cavity within the intermediate electrode. The holes were formed to have the bottom 35 cm above that of the electrodes, the top being 15 cm above that of the electrode at the electrolytic chamber end and the same level as the electrode top at the metal collecting chamber end, and sloped to an intermediate length therebetween. The partition was also provided with four 30 cm by 30 cm holes for passage of the bath back to the electrolytic chamber.

A composition of 20 $MgCl_2$-50 NaCl-30 $CaCl_2$ (by weight percent) was fused and introduced to the cell to approximately 15 cm over the top of intermediate electrodes. A tension of 38 volts was applied between the anode and cathode so there was a 3.8 volts tension between adjacent electrodes. Electrolytic run was continued for 24 hours at a bath temperature of 700° C. (as measured at the electrolytic chamber) and about 670° C. (at a bottom of the collecting chamber), an electrolytic current of 4500 A, a current density of 0.56 A/cm$^2$, with a current efficiency of approximately 94% and power consumption of approximately 8920 KHW/ton-Mg while making up for magnesium chloride ingredient consumed in the reaction and recovering magnesium metal and chlorine gas products. The collecting chamber was a little cooled from outside by a coolant gas (air) directed onto the wall at a portion of a decreased thickness. At the end 460 Kg of magnesium metal and 1360 Kg of chlorine gas were recovered.

The above said achievement is a substantial improvement over what cells of a conventional design usually can do in electrolysis of magnesium chloride: 14000~18000 KWH/ton-Mg with a simple cell design without any intermediate electrodes, and even over 9425 KWH/ton-Mg achieved only by a design similarly with such electrodes but no bath passage within the electrodes as according to the invention.

What I claim is:

1. An improved electrolytic cell for magnesium chloride which essentially comprises: at least one pair of anode and cathode arranged with a respective principal face thereof in substantial verticality, at least one bipolar intermediate electrode placed in a row between the anode and cathode, an electrolytic chamber to contain such electrodes, and a metal collecting chamber which is attached to the electrolytic chamber but separated therefrom by a partition, characterized in that said intermediate electrode essentially consists of a substantially flat graphite portion to provide an anodic face and an iron portion, which consists of several pieces, to provide a cathodic face, both of said materials being spaced from each other and joined together with rods of iron which are tightly secured to the graphite so as to ensure an intimate electrical connection therebetween, and that a cavity thus formed between the two materials is so arranged as to fitly communicate at one end with a through hole in the partition to allow passage of electrolyte bath carrying magnesium metal product from the electrolytic chamber to the metal collecting chamber.

2. A cell as recited in claim 1, in which said iron portion consists of a vertical row of several horizontal slats.

3. A cell as recited in claim 1, in which said iron portion consists of a transversel row of several vertical slats.

4. An improved electrolytic cell for magnesium chloride which essentially comprises: at least one pair of anode and cathode arranged with a respective principal face thereof in substantial verticality, at least one bipolar intermediate electrode placed in a row between the anode and cathode, an electrolytic chamber to contain such electrodes, and a metal collecting chamber which is attached to the electrolytic chamber but separated therefrom by a partition, characterized in that said intermediate electrode essentially consists of a substantially flat graphite portion to provide an anodic face and an iron portion to provide a cathodic face, said iron portion exhibiting an outside surface at least partially so inclined against the graphite portion as to be convergent upwards therewith, said materials being spaced from each other and joined together with rods of iron which are tightly secured to the graphite so as to ensure an intimate electrical connection therebetween, and that a cavity thus formed between the two materials is so arranged as to fitly communicate at one end with a through hole in the partition to allow passage of electrolyte bath carrying magnesium metal product from the electrolytic chamber to the metal collecting chamber.

5. A cell as recited in claim 4, in which said iron portion substantially consists of a continuous sheet of iron which has a bend towards the graphite at an upper portion thereof.

6. A cell as recited in claim 4, in which said iron portion consists of several horizontal slats commonly inclined so as to be upwards convergent with the graphite portion and commonly spaced therefrom.

7. An improved electrolytic cell for magnesium chloride which essentially comprises: at least one pair of anode and cathode arranged with a respective principal face thereof in substantial verticality, at least one bipolar intermediate electrode placed in a row between the anode and cathode, an electrolytic chamber to contain such electrodes, and a metal collecting chamber which is attached to the electrolytic chamber but separated therefrom by a partition, characterized in that said intermediate electrode essentially consists of a substantially flat graphite portion to provide an anodic face and iron portion to provide a cathodic face, both of said materials being spaced from each other and joined together with threaded bolts of iron which are tightly secured to the graphite so as to ensure an intimate electrical connection therebetween, and that a cavity thus formed between the two materials is so arranged as to fitly communicate at one end with a through hole in the partition to allow passage of electrolyte bath carrying magnesium metal product from the electrolytic chamber to the metal collecting chamber.

8. An improved electrolytic cell for magnesium chloride which essentially comprises: at least one pair of anode and cathode arranged with a respective principal face thereof in substantial verticality, at least one bipolar intermediate electrode placed in a row between the anode and cathode, an electrolytic chamber to contain such electrodes, and a metal collecting chamber which is attached to the electrolytic chamber but separated therefrom by a partition, characterized in that said intermediate electrode essentially consists of a substantially flat graphite portion to provide an anodic face and iron portion to provide a cathodic face, both of said materials being spaced from each other and joined together with rods of iron which are tightly secured to the graphite so as to ensure an intimate electrical connection therebetween, and that a cavity thus formed between the two materials is so arranged as to fitly communicate at one end with a through hole in the partition to allow passage of electrolyte bath carrying magnesium metal product from the electrolytic chamber to the metal collecting chamber, said cavity and hole in communicated relation exhibiting end openings in adjacency of similar cross sections to each other.

9. A cell as recited in claim 8, in which said end opening of the hole has a bottom at a same level with that of the cavity.

10. A cell as recited in claim 8, in which said end opening of the hole has a bottom rather raised from that of the cavity.

11. A cell as recited in claim 8, in which said cross section of the hole substantially is parallelogrammic.

12. A cell as recited in claim 8, in which said cross section of the hole substantially is rectangular.

13. A cell as recited in claim 8, in which said hole in the partition has a top above the top of intermediate electrode but below a bath surface level.

14. A cell as recited in claim 8, in which said hole has a top of a substantially constant level over all a length thereof.

15. A cell as recited in claim 8, in which said hole has a down inclination on the top towards the metal collecting chamber.

16. A cell as recited in claim 15, in which said down inclination terminates at a metal collecting chamber end of the hole.

17. A cell as recited in claim 15, in which said down inclination terminates in short of a metal collecting chamber end of the hole.

18. An improved electrolytic cell for magnesium chloride which essentially comprises: at least one pair of anode and cathode arranged with a respective principal face thereof in substantial verticality, at least one bipolar intermediate electrode placed in a row between the anode and cathode, an electrolytic chamber to contain such electrodes, and a metal collecting chamber which is attached to the electrolytic chamber but separated therefrom by a partition, characterized in that said intermediate electrode essentially consists of a substantially flat graphite portion to provide an anodic face and an iron portion to provide a cathodic face, said graphite and iron portions being joined together with rods of iron which are tightly secured to the graphite so as to ensure an intimate electrical connection but being separated from each other at a space given therebetween which decreases towards the partition, and that a cavity thus formed between the graphite and iron is so arranged as to fitly communicate at one end with a through hole in the partition to allow passage of electrolyte bath carrying magnesium metal product from the electrolytic chamber to the metal collecting chamber.

19. A cell as recited in claim 18, in which said space between the graphite and iron portions decreases continuously.

20. A cell as recited in claim 18, in which said space between the graphite and iron portions decreases stepwise.

* * * * *